US005671462A

United States Patent [19]

Toyohara et al.

[11] Patent Number: 5,671,462

[45] Date of Patent: Sep. 23, 1997

[54] FIXING DEVICE HAVING A POWER SUPPLY CONTROL ELEMENT FOR CONTROLLING A TEMPERATURE OF A HEAT MEMBER

[75] Inventors: Yuichiro Toyohara; Tsuyoshi Kunishi, both of Yokohama, Japan

[73] Assignee: Canon Kabushiki Kaisha, Tokyo, Japan

[21] Appl. No.: 504,760

[22] Filed: Jul. 19, 1995

[30] Foreign Application Priority Data

Jul. 22, 1994 [JP] Japan ..... 6-191256
Aug. 30, 1994 [JP] Japan ..... 6-227461

[51] Int. Cl.[6] ..... G03G 15/20

[52] U.S. Cl. ..... 399/33; 399/330

[58] Field of Search ..... 355/282, 285, 355/289, 290, 203, 204, 208; 219/216; 118/60; 399/33, 44, 320, 328, 330, 335

[56] References Cited

U.S. PATENT DOCUMENTS 5,041,718 8/1991 d'Hondt et al. ..... 219/216 X
5,109,255 4/1992 Nishikawa et al. ..... 355/285
5,241,159 8/1993 Chatteriee et al. ..... 219/216 X
5,355,203 10/1994 Nishikawa et al. ..... 355/285
5,412,453 5/1995 Matsuo ..... 355/208

*Primary Examiner*—Sandra L. Brase
*Attorney, Agent, or Firm*—Fitzpatrick, Cella, Harper & Scinto

[57] ABSTRACT

A fixing device includes a first heater, a second heater having a heat distribution different from that of the first heater, a heating member heated by the first and second heaters, and a temperature detecting element for detecting the temperature of the heating member. A power supply control element controls the power supply to the first heater and second heater in such a manner that the temperature detected by the temperature detecting element is maintained at a target temperature. After a fixing operation and until the temperature detected by the temperature detecting element rises from the fixing temperature to a stand-by temperature higher than the fixing temperature, the power supply element is adapted to effect power supply control different from that in the stand-by state.

5 Claims, 11 Drawing Sheets

FIXING DEVICE HAVING A POWER SUPPLY CONTROL ELEMENT FOR CONTROLLING A TEMPERATURE OF A HEAT MEMBER

BACKGROUND OF THE INVENTION

1. Field of the Invention

The present invention relates to a fixing device for heating a recording material bearing an unfixed image thereon, thereby fixing said unfixed image to the recording material.

2. Related Background Art

In image forming apparatus such as a copying apparatus or a printer, a roller fixing device utilizing heat and pressure is employed for fixing a toner image transferred onto a recording sheet. Such roller fixing device is provided with a fixing roller for heating the toner image on the recording sheet, and a pressure roller for pressing the recording sheet to the fixing roller, and the heat is supplied by a heater provided in the fixing roller.

In such fixing device, the fixing roller is recently constructed with a smaller heat capacity, with a thinner metal shell, in order to reduce the waiting time after the power supply of the image forming apparatus is turned on. Such fixing device of a low heat capacity has a high rate of temperature increase per unit time of energization of the heater, thus being capable of reducing the warm-up time and also avoiding the overshoot in temperature, resulting from delay in time of the temperature change of the fixing roller surface after the heater is turned on or off.

The reduction in waiting time is also reduced by a control of maintaining, in the absence of input of the image forming signal after the start of power supply, the fixing roller at a stand-by temperature lower than the fixing temperature employed in the fixation of the unfixed image on the recording material, and elevating the temperature of the fixing roller to the fixing temperature in response to the input of the image formation start signal.

However, as the heat capacity of the fixing roller is small, there cannot be accumulated sufficient heat therein in the stand-by state. Also, as the fixing roller and the pressure roller are both stopped in the stand-by state, the heat of the fixing roller is taken away by the pressure roller when both rollers are driven at the start of copying operation, so that the time to reach the fixing temperature cannot be shortened sufficiently despite the small heat capacity of the fixing roller. This drawback can be prevented by the use of a heater of a larger power, but such method is undesirable as it increases the power consumption of the apparatus.

For avoiding the above-mentioned drawbacks, there is proposed a method of maintaining the temperature in the stand-by state higher than that at the copying operation.

On the other hand, in the fixing device of the above-explained heat roller type, heat tends to be dissipated in the stand-by state from both ends of the fixing roller, so that the temperature thereof decreases at both ends. Such heat loss does not cause a problem in the fixing operation in case of a narrow recording sheet which can be passed in an area not suffering such heat loss, but induces insufficient fixation on both sides in case of a wide recording sheet.

For avoiding such defective fixation, there can be conceived to alter the heat distribution of the heater so as to attain a higher temperature on both end portions of the fixing roller than in the central portion, but, in such configuration, if narrow recording sheets are passed, the heat is not taken away by the recording sheets in both end portions of higher temperature, whereby so-called temperature elevation in sheet non-passing areas is generated.

It is therefore also proposed to provide, inside the fixing roller, a main heater of a distribution with a higher heat amount in the center and a sub heater of a distribution with a higher heat amount in the end portions and to alternately activate said main heater and sub heater, in the fixing operation, with a predetermined time ratio (hereinafter called flashing rate) to achieve uniform temperature distribution along the longitudinal direction of the fixing roller, and, in the stand-by state, to increase the activation ratio of the sub heater thereby preventing the heat loss on both ends of the fixing roller.

In this manner the fixing ability can be ensured even with the fixing roller of a low heat capacity, by employing plural heaters of mutually different heat distribution and selecting the temperature in the stand-by state higher than that in the fixing operation.

The temperature distribution in the longitudinal direction, in the stand-by state in this method, is shown by a solid line m in FIG. 11. As shown in this chart, the temperature in the stand-by state is 205° C., which is higher than 190° C. in the copying operation, and the temperature on both end portions is selected higher than that at the center.

Even if the heat is taken away from the fixing roller to the pressure roller when both rollers are put into rotation, and even in the presence of heat dissipation from the end portions of the fixing roller, such temperature control realizes uniform temperature distribution in the longitudinal direction of the fixing roller as indicated by a solid line l in FIG. 11, thereby preventing defective fixation immediately after the start of the copying operation.

However the above-mentioned temperature control method is still associated with a drawback, in case of elevating the temperature from 190° C. to the stand-by temperature of 205° C. after the copying operation, of generating an overshoot as indicated by a solid line n in FIG. 12, if the temperature is raised at a time by the above-mentioned flashing rate as in the stand-by state.

This phenomenon is caused because even a slight delay in the reaction, resulting from the time constant of the thermistor is sharply reflected on the surface temperature of the fixing roller, as the thin-shelled fixing roller has a large slope of temperature increase per unit time. This is also because the temperature at the end portions cannot be detected precisely as the thermistor is positioned at the center in the longitudinal direction in order to simplify the temperature control in the sheet passing area. Such overshoot in the end portions is eventually averaged, thus inducing similar overshoot also in the central portion of the fixing roller.

SUMMARY OF THE INVENTION

In consideration of the foregoing, an object of the present invention is to provide a fixing device capable of suppressing the overshoot phenomenon in case the temperature of the fixing roller is elevated from the fixing temperature to the stand-by temperature.

Another object of the present invention is to provide a fixing device provided with a first heater, a second heater of a heat distribution different from that of said first heater, a heating member heated by said first and second heaters, a temperature detecting element for detecting the temperature of said heating member, and power supply control means for controlling the power supply to said first and second heaters so as to maintain the temperature detected by said temperature detecting element at a target temperature. Wherein said power supply control means is adapted to effect power supply control different from that in a stand-by state, after the end of a fixing operation until the temperature detected by the temperature detecting element rises from the fixing temperature to the stand-by temperature higher than said fixing temperature.

Still other objects of the present invention will become fully apparent from the following detailed description which is to be taken in conjunction with the attached drawings.

DETAILED DESCRIPTION OF THE PREFERRED EMBODIMENTS

Now the present invention will be clarified in detail by preferred embodiments thereof, with reference to the attached drawings.

Figure 1:
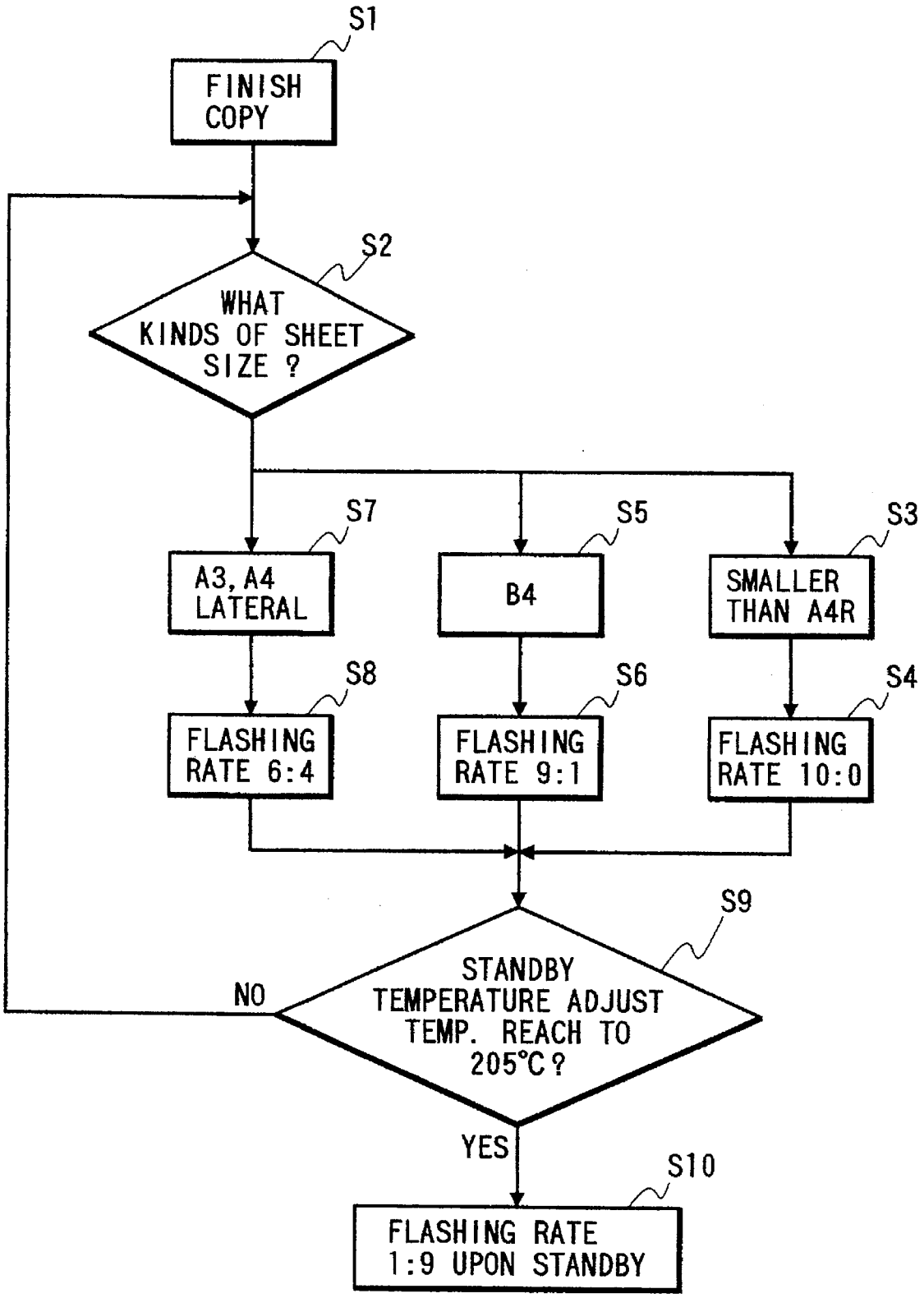
FIG. 1 is a flow chart showing heater control sequence in a first embodiment of the present invention.
Figure 2:
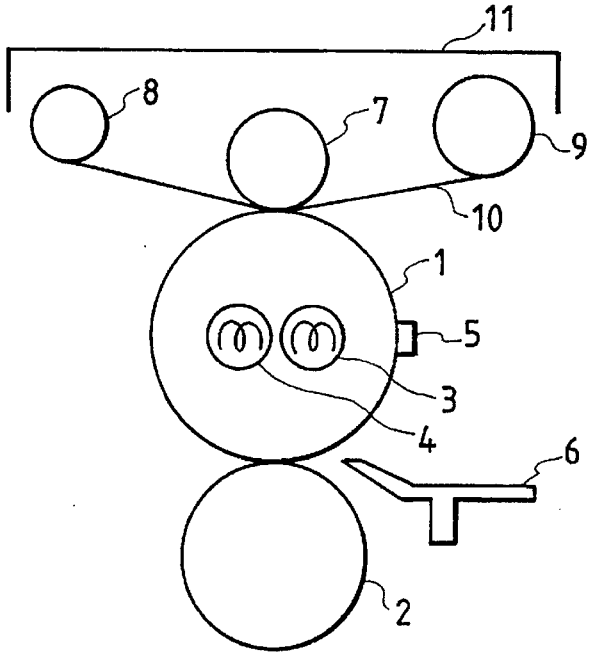
FIG. 2 is a cross-sectional view of a fixing device embodying the present invention.
Figure 3:
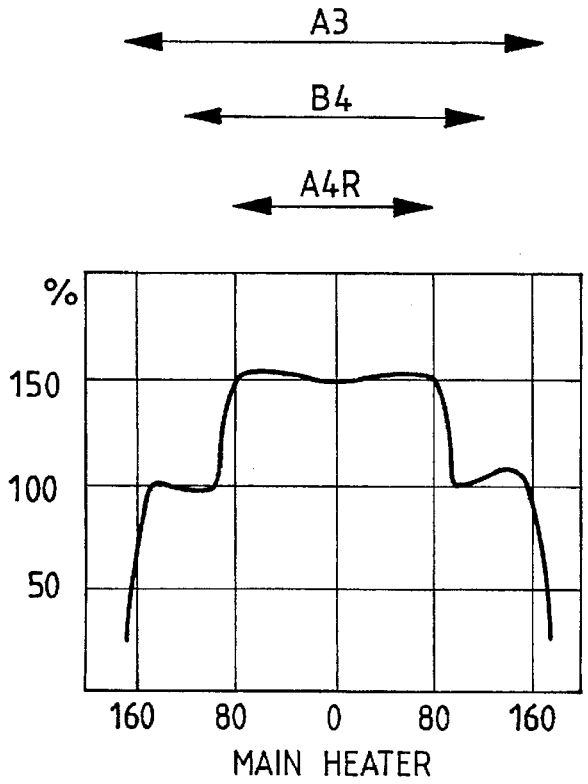
FIG. 3 is a chart showing the heat distribution of a main heater in an embodiment of the present invention.
Figure 4:
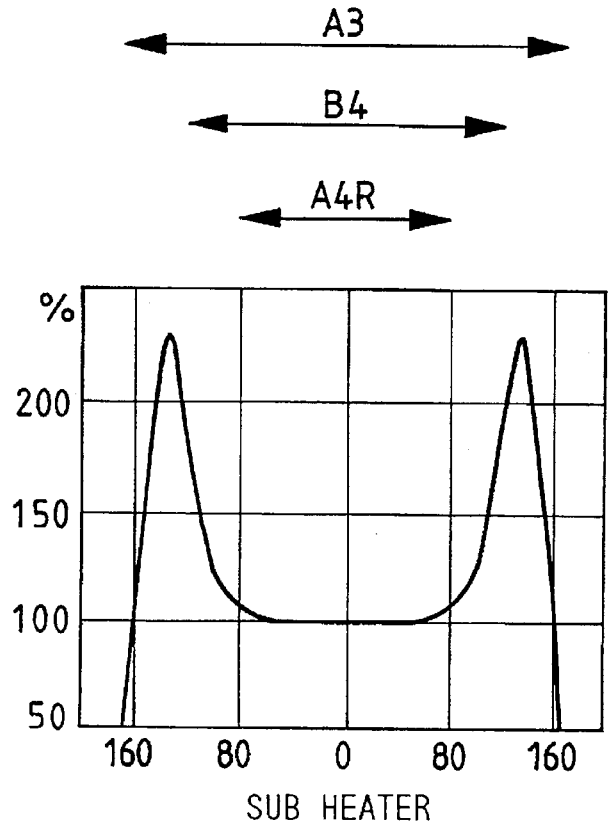
FIG. 4 is a chart showing the heat distribution of a sub heater in an embodiment of the present invention.
Figure 5:
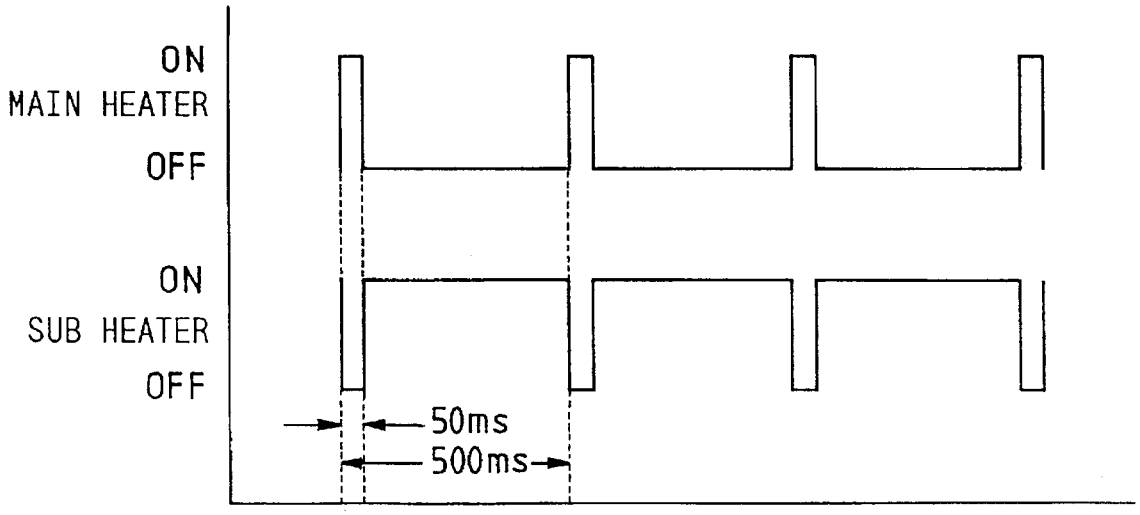
FIG. 5 is a timing chart showing flashing rate control of the main and sub heaters in the stand-by state, in a first embodiment of the present invention.
Figure 6:
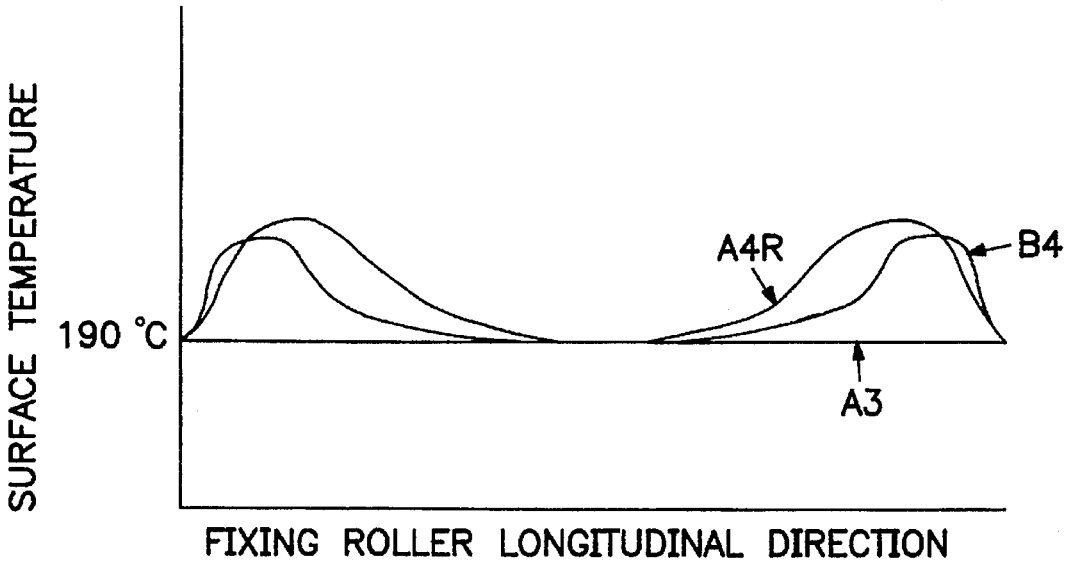
FIG. 6 is a chart showing temperature distribution of the fixing roller in the longitudinal direction thereof, after copying operation with recording sheets of different sizes, in the first embodiment of the present invention.
Figure 7:
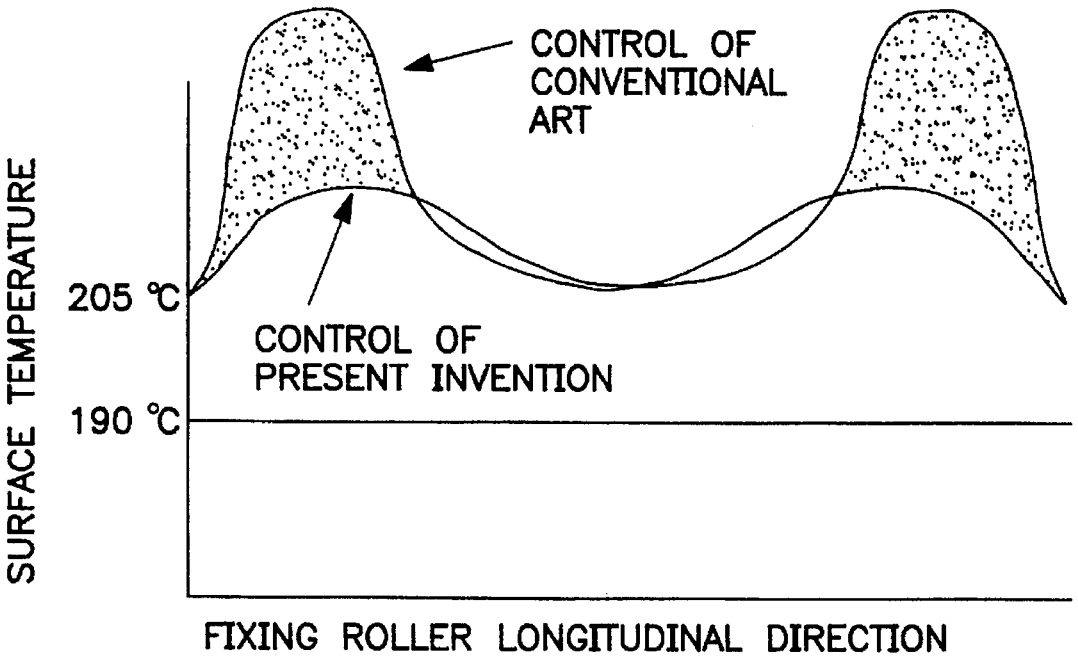
FIG. 7 is a chart showing temperature distribution of the fixing roller in the longitudinal direction thereof, when the stand-by temperature is reached after the copying operation in the first embodiment of the present invention and in the conventional control.

At first there will be explained, with reference to FIGS. 1 to 7, a first embodiment of the present invention. FIG. 1 is a flow chart showing the heater control sequence after a continuous copying operation, in an image forming apparatus employing a fixing device constituting a first embodiment of the present invention; FIG. 2 is a cross-sectional view of the structure of the fixing device of said embodiment; FIG. 3 is a chart showing the heat distribution of a main heater; FIG. 4 is a chart showing the heat distribution of a sub heater; FIG. 5 is a timing chart showing the timing of activation of the main heater and the sub heater the fixing roller reaches a stand-by temperature; FIG. 6 is a chart showing temperature distribution of the fixing roller in the longitudinal direction thereof after copying operation with recording sheets of different sizes, in said embodiment; and FIG. 7 is a chart showing temperature distribution of the fixing roller in the longitudinal direction thereof after the heater control according to the present embodiment and in the conventional control.

The fixing device of the present embodiment is provided, as shown in FIG. 2, with a fixing roller 1 for heating a toner image present on a recording sheet or a recording material, and a pressure roller 2 for pressing the recording sheet to the fixing roller 1, and said fixing roller 1 is provided therein with heaters 3, 4 constituting heating means for heat supply to said fixing roller 1. Above the fixing roller 1 there is provided an oil application unit 11 including a pressing roller 7 for pressing a web, fed from a feed roll 8 and taken up on a take-up roll 9, onto the surface of the fixing roller 1.

The fixing roller 1 is composed of a thin roller with an iron shell of a thickness of 0.7 mm, and the pressure roller 2 is composed of silicone rubber covered with PFA tube. The surface temperature of the fixing roller 1 is detected by a thermistor 5, constituting temperature detecting means, provided at the center in the longitudinal direction, and is so controlled as to be maintained at a target temperature. The thermistor 5 is of a time constant of about 2 seconds.

The heaters 3, 4, provided inside the fixing roller 1, respectively constitute a main heater 3 having a light amount (heat) distribution larger at the central portion, and a sub heater 4 having a distribution larger at the end portions, as schematically shown in FIGS. 3 and 4. These heaters have outputs of 700 and 600 W, respectively. These two heaters 3, 4 are not turned on continuously at the same time, but are alternately turned on by power supply control means such as a CPU, with a certain turn-on ratio (hereinafter called flashing rate) according to the sheet size, within each predetermined unit time (taken as 500 ms in the present embodiment).

In the present embodiment, the flashing rate (of main heater: sub heater) is selected as 7:3 in case of passing A3-sized sheets, 8:2 in case of passing B4-sized sheets, and 10:0 in case of passing A4R-sized or smaller sheets. The above-mentioned flashing rates are adopted since the sheets are always passed at the center in the longitudinal direction, but the heat distributions of the heaters and the flashing rates have to be selected differently if the sheets are passed with an end thereof at an end of the longitudinal direction.

The surface temperature of the fixing roller is detected by the thermistor positioned at the center of the longitudinal direction of the fixing roller, and the power supply to the two heaters is so controlled that said surface temperature is maintained at a predetermined control temperature. More specifically, if the temperature detected by the thermistor is higher than the control temperature, the power supplies to the two heaters are both turned off, but, if the detected temperature is lower than the control temperature, the two heaters are powered with a predetermined flashing rate.

In the present embodiment, the control temperature in the stand-by state (stand-by temperature) is selected as 205° C., while the control temperature during the continuous copying operation (fixing temperature) is selected as 190° C.

The stand-by temperature of 205° C. is selected in consideration of an experimental result that the lowest temperature required for the fixing roller for securing the necessary fixing temperature for the first copy, even after the heat is taken away by the pressure roller at the start of the copying operation, is 205° C.

Also in the present embodiment, in addition to the temperature mentioned above, the flashing rate in the stand-by state is selected to be different from the above-mentioned flashing rates in the copying state. Such control is in consideration of a fact that the above-mentioned loss of the surface temperature of the fixing roller immediately after the start of copying operation is particularly conspicuous at the end portions of the fixing roller where the heat dissipation occurs more easily. Thus, in the stand-by state, the flashing rate of the sub heater 4 is increased to maintain the end portions of the fixing roller at a somewhat higher temperature.

In the present embodiment, in the stand-by state, the flashing rate of the main heater 3 and the sub heater 4 is maintained at 1:9 as shown in FIG. 5.

However, as already explained in the description of the related background art, there will result a temperature overshoot if the temperature is raised at a time, after the copying operation, with the flashing rate of the stand-by state. Consequently, in the present embodiment, the overshoot phenomenon is suppressed by selecting a new flashing rate from the end of the copying operation to the arrival at the stand-by temperature.

More specifically, during a period from the end of the copying operation to the arrival at the stand-by temperature, temperature is raised with such a flashing rate that provides heat less in the end portions, in the longitudinal direction of the fixing roller, than in the central portion, and the above-mentioned stand-by flashing rate, providing larger heat in the end portions, is restored when the detected temperature of the thermistor reaches the stand-by temperature.

In this manner it is rendered possible, even in elevating the temperature of the fixing roller to the stand-by temperature immediately after the end of the copying operation, to prevent temperature overshoot at the end portions of the fixing roller and also to prevent defective fixation at the start of the next copying operation.

Besides, in the present embodiment, the flashing rate from the end of the copying operation to the arrival of the surface temperature of the fixing roller at the stand-by temperature is suitably varied according to the sheet size employed in the copying operation. This is because the temperature distribution in the longitudinal direction of the fixing roller, at the end of the copying operation, varies depending on the sheet size. FIG. 6 shows the temperature distribution of the fixing roller in the longitudinal direction thereof, after a copying operation of ten copies with different sheet sizes.

In the copying with sheets of A4R or smaller size, the flashing rate during the copying operation is set at 10:0, but the end portions tend to become higher in temperature as shown in FIG. 6. Consequently, in such case, the excessive heat accumulated in the end portions can also be utilized as the energy for reaching the stand-by temperature, and the heat to be given for heating the fixing roller to the stand-by temperature after the copying operation can be more concentrated in the central portion, so that the ratio of power supply to the sub heater can be further reduced. In the present embodiment there is employed a flashing rate of 10:0.

Also in case of A3-sized sheets, the fixing roller after the copying operations has a flat temperature distribution along the longitudinal direction thereof. In such case, the temperature of the fixing roller can be raised, without overshoot, by more or less flat heating. For maintaining such flat temperature state, the combined heat distribution of the main and sub heaters has to be substantially flat, and a flashing rate meeting such purpose is selected. In the present embodiment, a flashing rate of 6:4 is selected as it is optimum for achieving such state.

In case of B4-sized sheets, the energy accumulated in the end portions is less than that in case of the A4R or smaller sheets, the heat to be given for heating the fixing roller to the stand-by temperature after the copying operation can be concentrated in the central portion as in the case of the A4R or smaller sheets, so that the ratio of the sub heater energization can be reduced. In the present embodiment there is selected a flashing rate of 9:1.

The above-explained heater control of the present embodiment from the end of the copying operation to the stand-by state will be explained with reference to a flow chart shown in FIG. 1.

After the end of the copying operation (step S1), there is discriminated the sheet size in the immediately preceding copying operation (step S2), and, if the sheet size is A4R or smaller (step S3), the flashing rate (main heater: sub heater) from the end of the copying operation to the arrival of the surface temperature of the fixing roller to the stand-by temperature is selected as 10:0 (step S4). If the sheet size in the immediately preceding copying operation is B4 (step S5), the flashing rate from the end of the copying operation to the arrival of the surface temperature of the fixing roller at the stand-by temperature is set at 9:1 (step S6). Also in case the sheet size in the immediately preceding copying operation is A3 (step S7), the flashing rate from the end of the copying operation to the arrival of the surface temperature of the fixing roller at the stand-by temperature is selected as 6:4 (step S8). While the power supply to the heaters is continued with any of the above-mentioned flashing rates, there is detected whether the temperature of the fixing roller has reached the stand-by temperature of 205° C. (step S9), and if reached, the flashing rate thereafter is set at 1:9 (step S10).

The specific flashing rates are not limited to the values mentioned above, but can be suitably selected according, for example, to the thickness of the fixing roller, heat distribution of the heaters and the outputs thereof.

FIG. 7 shows the temperature distribution in the longitudinal direction when the temperature detected by the thermistor reaches 205° C. after the copying operation with the A3-sized sheets. As will be apparent from FIG. 7, the present embodiment enables heating from the fixing temperature to the stand-by temperature, without wasting the excessive heat generated in the end portions of the fixing roller during the copying operation and still minimizing the overshoot phenomenon.

The elimination of the temperature overshoot relaxes the heat resistance required in all the members associated with the fixing device, such as the fixing roller, pressure roller and cleaning member maintained in contact with the fixing roller, whereby it is rendered possible to reinforce the specific performance required for such member, such as the cleaning property in case of the cleaning member or the anti-offset releasing property in case of the fixing roller. Also the cost reduction can be facilitated.

Figure 10:
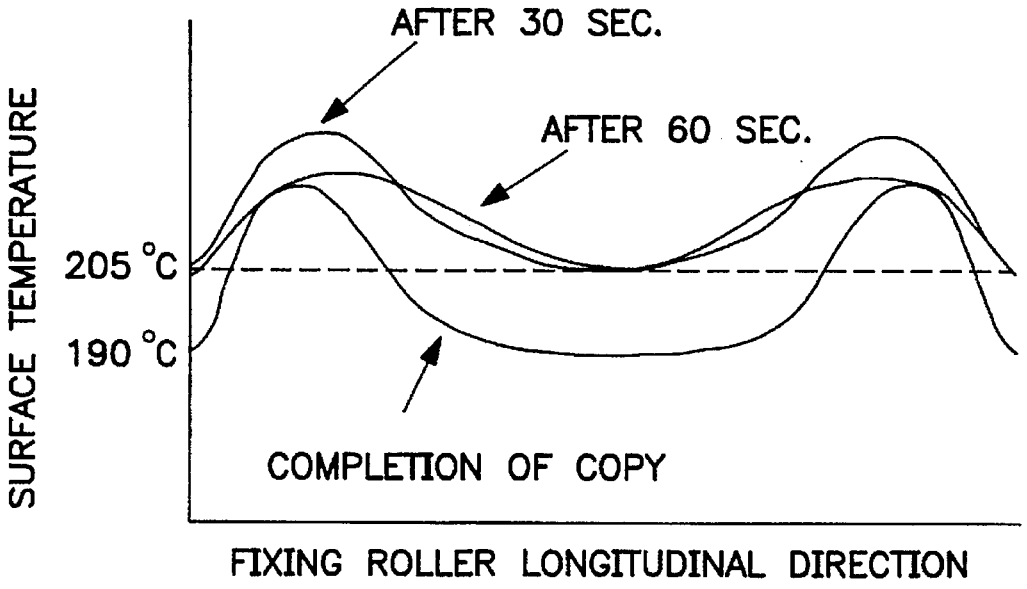
FIG. 10 is a chart showing the temperature distribution of the fixing roller in the longitudinal direction thereof after a predetermined time from a copying operation with an A4R-sized sheet, in the second embodiment of the present invention.
Figure 11:
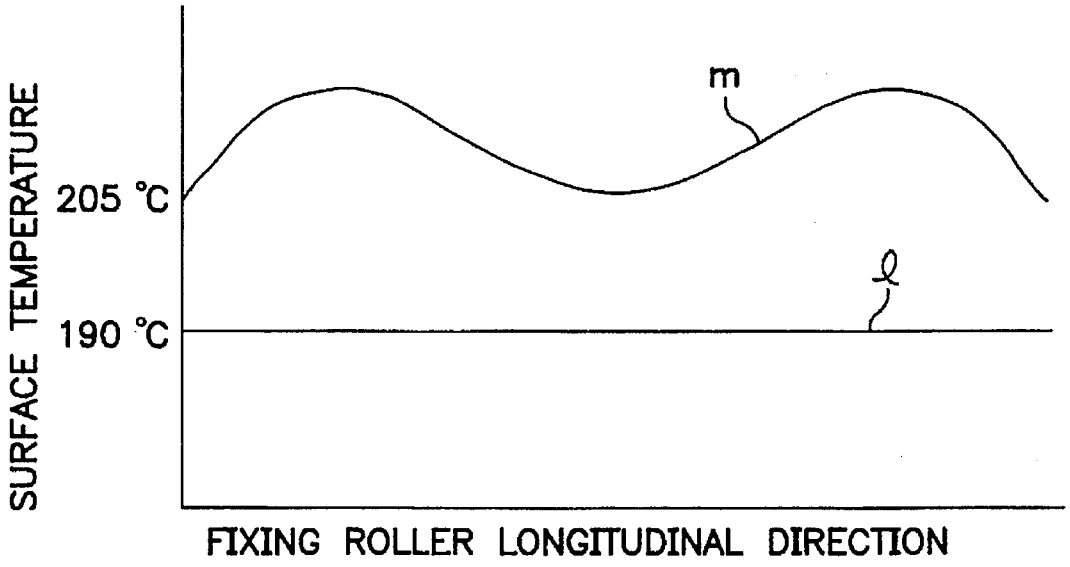
FIG. 11 is a chart showing the ideal temperature distribution of the fixing roller in the longitudinal direction thereof in the stand-by state and in the fixing operation in a conventional device.
Figure 12:
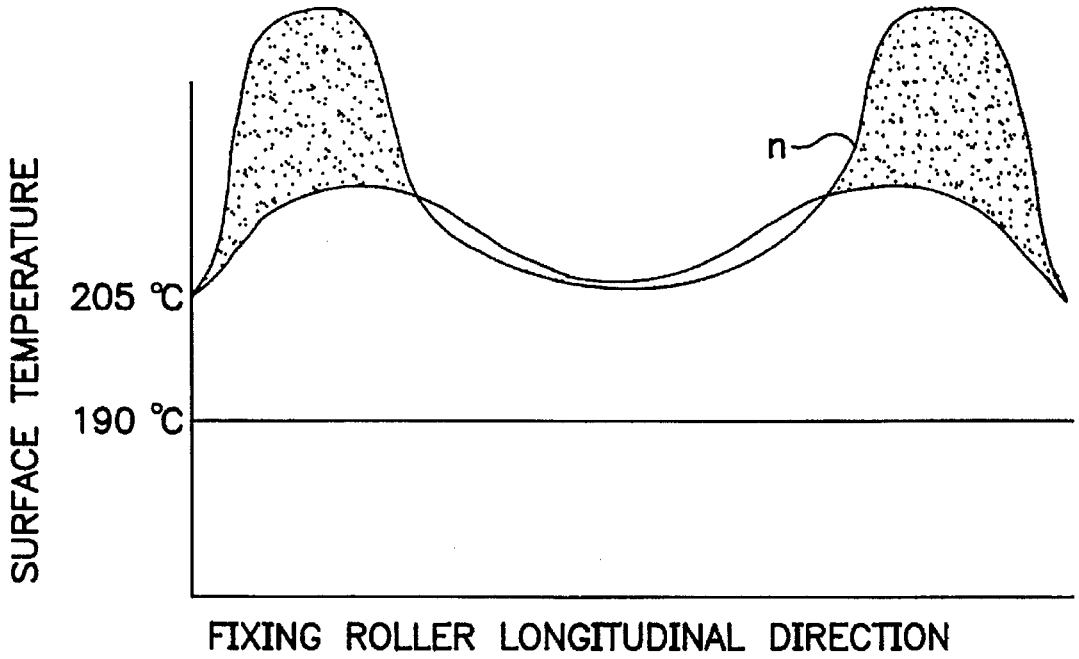
FIG. 12 is a chart showing the temperature distribution of the fixing roller in the longitudinal direction thereof when the stand-by temperature is reached after a copying operation in a conventional device.

In the following there will be explained a second embodiment of the present invention, with reference to FIG. 10. In the following description, components that are the same as those in the first embodiment are represented by the same symbols and will not be explained further.

Figure 9:
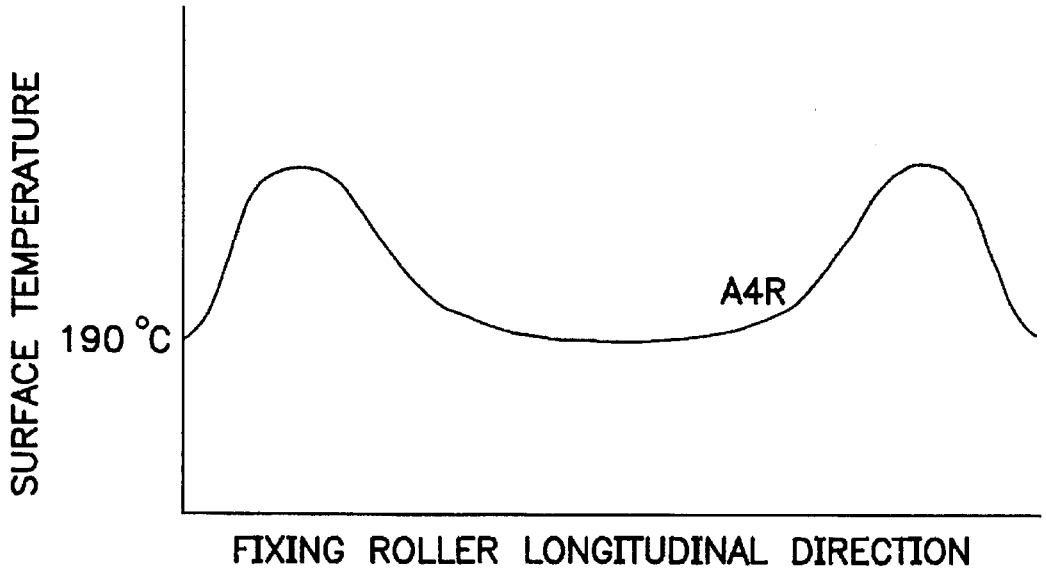
FIG. 9 is a chart showing the temperature distribution of the fixing roller in the longitudinal direction thereof after a copying operation with an A4R-sized sheet, in the second embodiment of the present invention.

FIG. 9 shows the temperature distribution of the fixing roller in the longitudinal direction thereof, after 50 copying operations with A4R-sized sheets. As will be apparent from FIG. 9, the temperature of the fixing roller becomes higher in the end portions after copying with small-sized sheets, but, with the lapse of time, the heat in the end portions migrate to provide an ideal temperature distribution in the stand-by state as shown in FIG. 10.

Consequently, even after copying with the A4R-sized sheets, the heater control can be executed with a flashing rate same as after the fixing roller reaches the stand-by temperature, after the lapse of a predetermined time, 60 seconds in this case, from the end of the copying operation.

Figure 8:
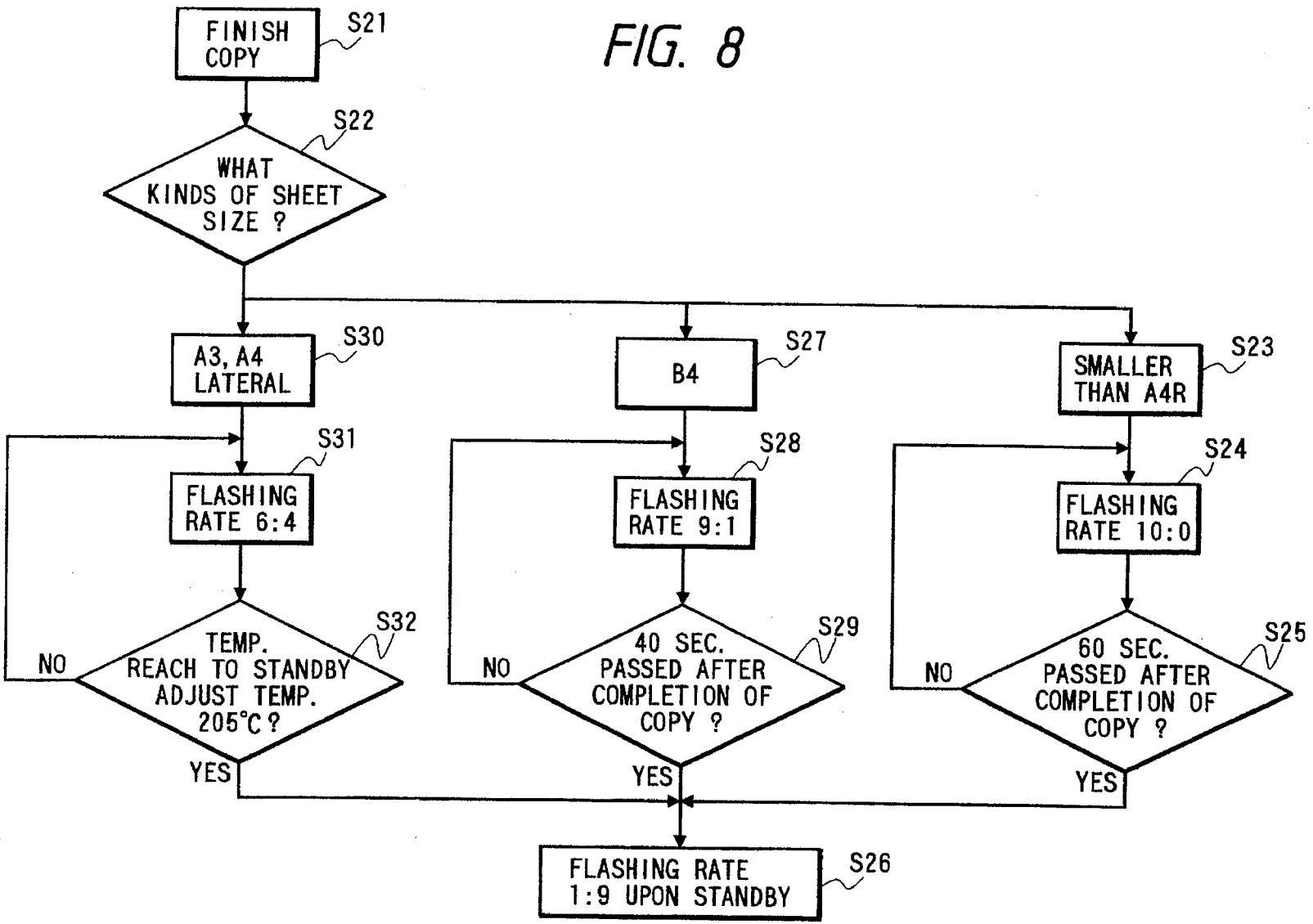
FIG. 8 is a flow chart showing heater control sequence in a second embodiment of the present invention.

Such heater control of the present embodiment will be explained with reference to FIG. 8. After the copying operation (step S21), the sheet size immediately before the end of the copying operation is detected (step S22), and, if said size is A4R or smaller (step S23), the flashing rate from the end of the copying operation to the arrival of the surface temperature of the fixing roller at the stand-by temperature is selected as 10:0 (step S24). Then there is discriminated whether 60 seconds have elapsed after the end of the copying operation (step S25), and, after the lapse of 60 seconds, the flashing rate is set as 1:9 (step S26). If the sheet size at the end of the copying operation is B4 (step S27), the flashing rate from the end of the copying operation to the arrival of the surface temperature of the fixing roller at the stand-by temperature is selected as 9:1 (step S28). Then there is discriminated whether 40 seconds have elapsed after the end of the copying operation (step S29), and, after the lapse of 40 seconds, the flashing rate is set as 1:9 (step S26).

In case the sheet size at the end of the copying operation is A3 (step S30), the flashing rate from the end of the copying operation to the arrival of the surface temperature of the fixing roller at the standby temperature is selected as 6:4 (step S31). Then there is discriminated whether the fixing roller has reached the stand-by temperature which is 205° C., while the power supply to the heaters is continued (step S32), and, after the arrival, the flashing rate is selected as 1:9 (step S26).

Such control allows to reduce the time required to reach the stable temperature distribution in the stand-by state.

In the following there will be explained a third embodiment of the present invention, in which the cross-sectional configuration of the fixing device is the same as that in the first embodiment.

The heaters 3, 4 are not turned continuously at the same time, but are alternately turned on by temperature control means such as a CPU, with a certain turn-on ratio, within each predetermined unit time (500 ms in the present embodiment), in the stand-by state and in the copying state, and said turn-on ratio in the copying state is further varied according to the sheet size. The turn-on ratio of the heaters 3, 4 is called flashing rate.

In the stand-by state, as the heat is dissipated from the ends of the fixing roller 1, the flashing rate of the sub heater 4 is increased to obtain somewhat higher temperature at the end portions. More specifically, the flashing rate of the main heater 3 and the sub heater 4 is selected as 1:9. The flashing rate in the copying state is varied according to the sheet size, as 7:3 for the A3-sized sheets, 8:2 for the B4-sized sheets, and 10:0 for the A4R-sized or smaller sheets.

In the above-explained fixing device of the present embodiment, the stand-by temperature is selected as 205° C., while the control temperature during the continuous copying operation is selected as 190° C.

The stand-by temperature of 205° C. is selected in consideration of a fact that the lowest temperature required for the fixing roller for securing the necessary fixing temperature for the first copy, even after the heat is taken away by the pressure roller at the start of the copying operation, is 205° C.

However, as the conventional temperature control after the continuous copying operation to the stand-by temperature results in an overshoot phenomenon, the present embodiment stepwise raises the control temperature in consideration of the heat conduction time in the longitudinal direction of the fixing roller 1 and the time constant of the thermistor 5, for suppressing the overshoot.

Figure 13:
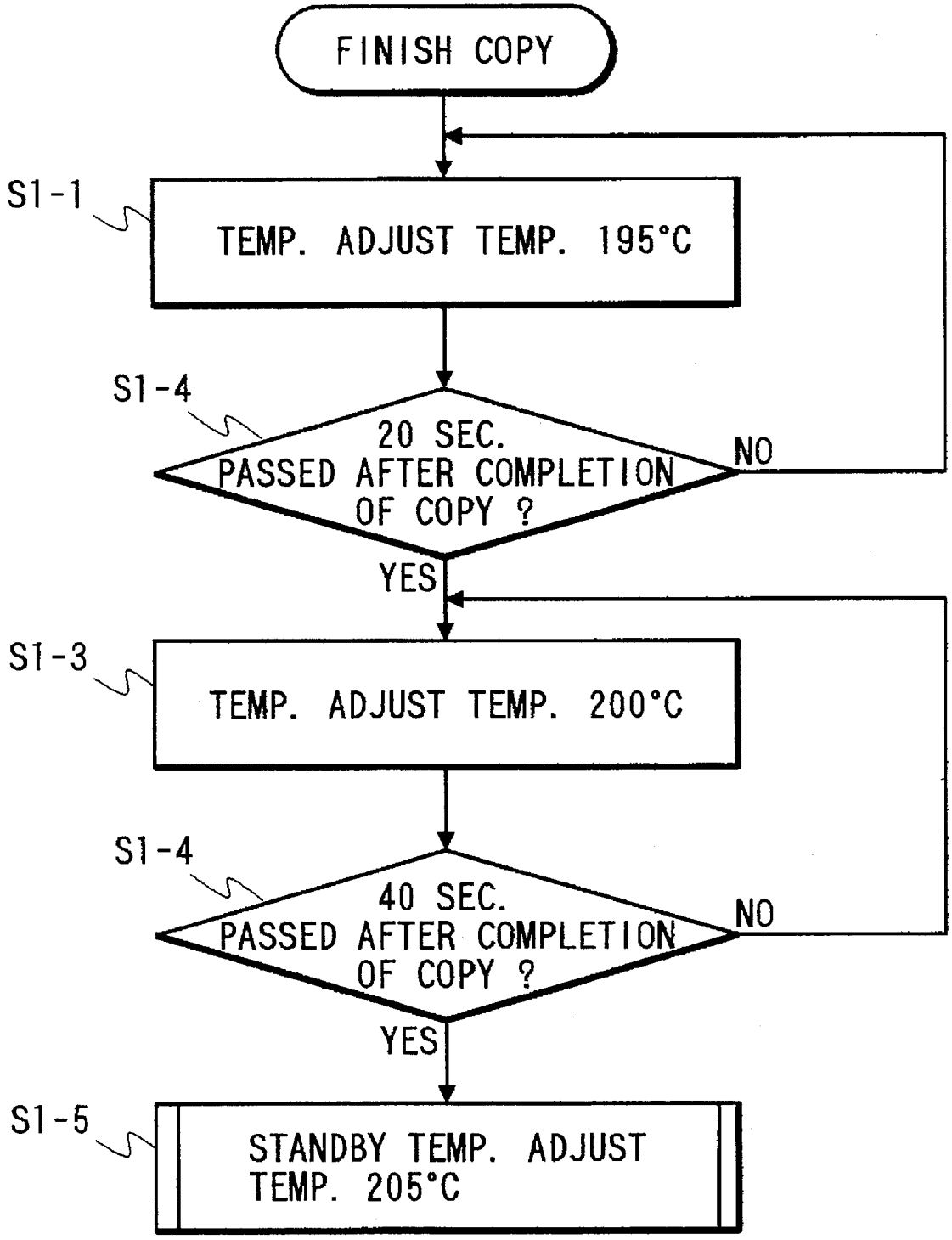
FIG. 13 is a flow chart showing heater control sequence in a third embodiment of the present invention.
Figure 14:
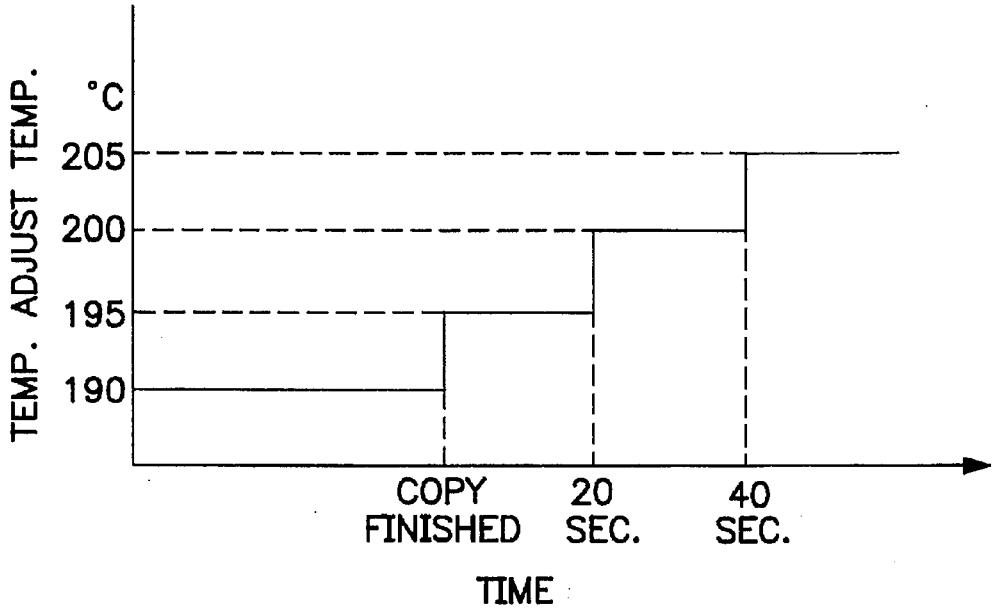
FIG. 14 is a chart showing the variation of the controlled temperature in a third embodiment of the present invention.

More specifically, as shown in FIG. 13, in case the control temperature immediately before the end of the copying operation is 190° C., the temperature control is conducted at 195° C. for 20 seconds (steps S1-1 and S1-2), then conducted at 200° C. for the next 20 seconds (steps S1-3 and S1-4), and finally at the 205° C. which is the normal stand-by temperature (step S105). In this manner there is executed control for stepwise raising the control temperature as shown in FIG. 14, but the number of steps and the duration of each step are not limited to the values mentioned above but may be suitably selected in each system.

If the temperature is raised with the flashing rate of the stand-by state instead of the above-explained stepwise temperature elevation, the temperature becomes higher only in the end portions and lower in the central portion, and the difference in temperature in the longitudinal direction causes the overshoot phenomenon. In the present embodiment, the control temperature is elevated stepwise, whereby a time is obtained, in each temperature step, to reduce the temperature difference in the longitudinal direction of the fixing roller.

Figure 15:
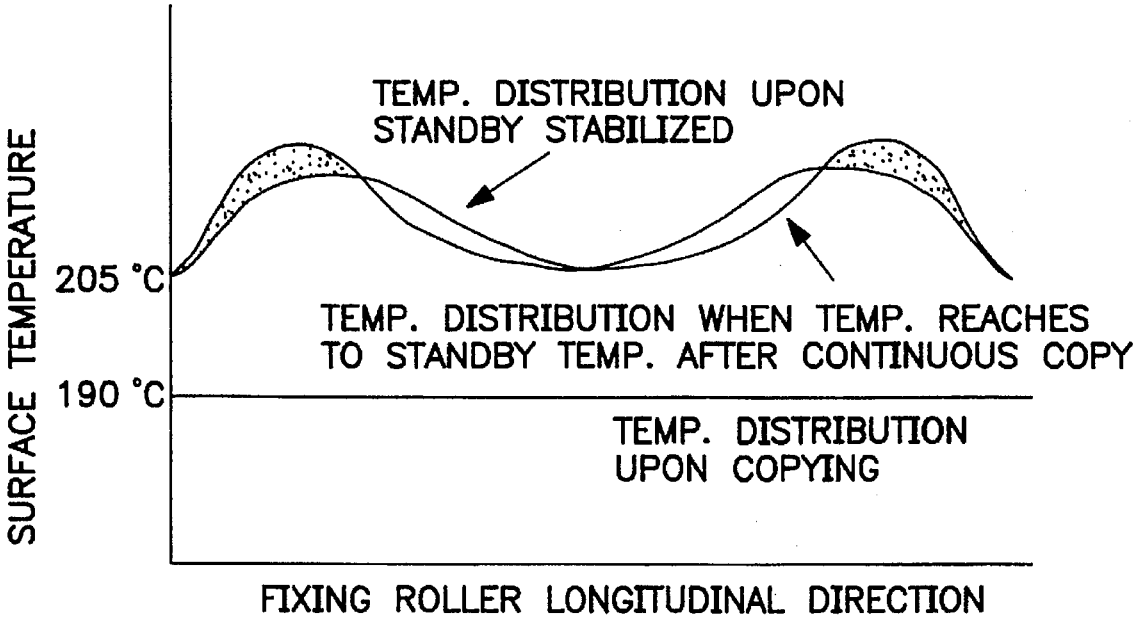
FIG. 15 is a chart showing the temperature distribution of the fixing roller in the longitudinal direction thereof, when the stand-by temperature is reached after the copying operation, in the third embodiment of the present invention.

Such control reduces the temperature difference in the longitudinal direction of the fixing roller 1 in each temperature step, so that the temperature at the end portions is maintained lower when the central portion finally reaches 205° C. and a significant overshoot can be prevented as shown in FIG. 15.

In the following there will be explained a fourth embodiment of the present invention, with reference to FIG. 16, wherein components same as those in the first embodiment are represented by the same symbols and will not be explained further.

Figure 16:
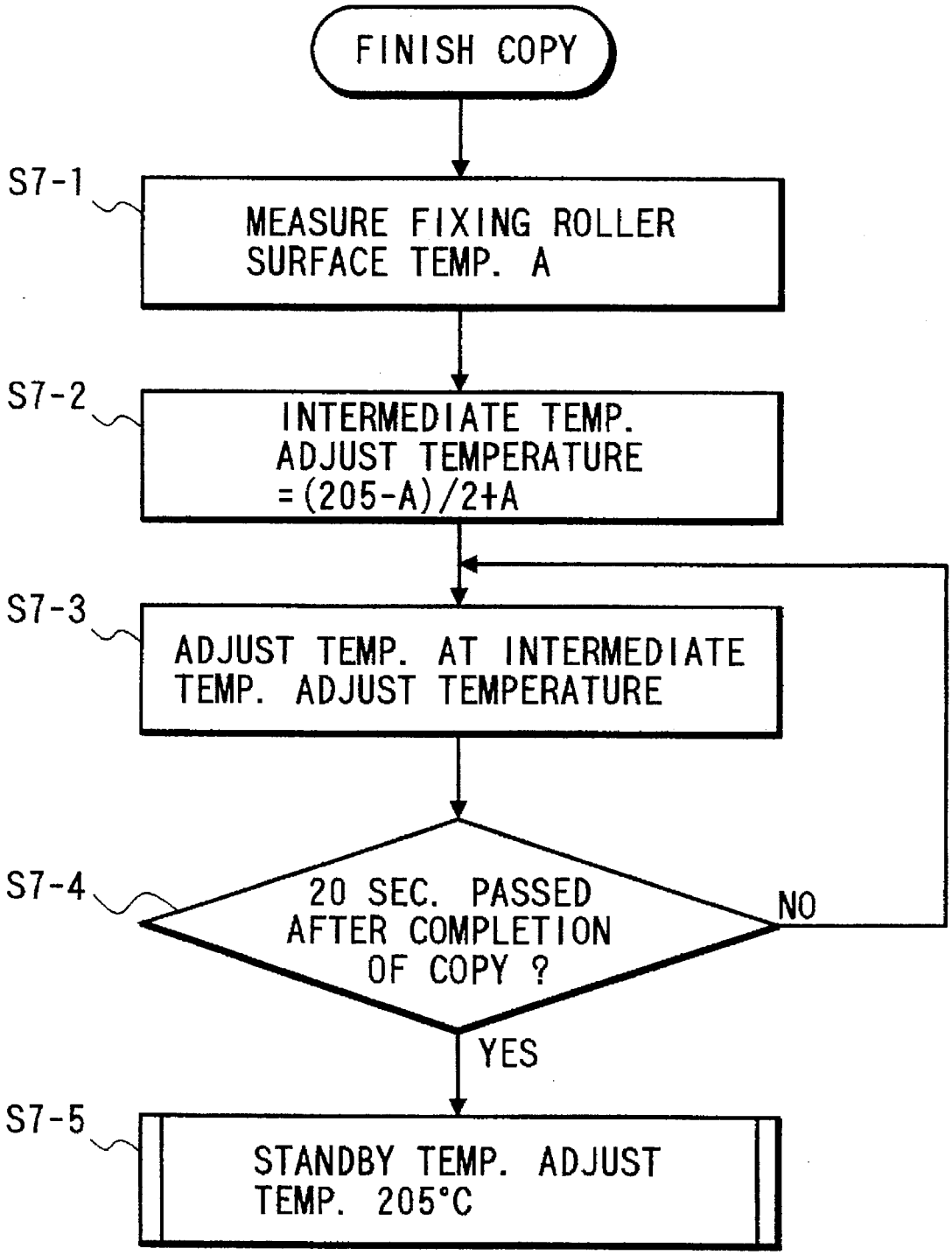
FIG. 16 is a flow chart showing the temperature control sequence in a fourth embodiment of the present invention.

FIG. 16 is a flow chart showing the control sequence of the present embodiment. The configuration of the device of the present embodiment is the same as that of the first embodiment, except for the temperature control sequence to be explained in the following. At first, at the end of the continuous copying operation, the surface temperature A of the fixing roller is detected by the thermistor (step S7-1), then the difference between said temperature A and the stand-by temperature is calculated, and there is set an intermediate control temperature in the course from the continuous copying operation to the stand-by temperature control (step S7-2).

More specifically, the intermediate control temperature is selected at the center between the stand-by temperature, for example 205° C., and the roller temperature at the end of the continuous copying operation. Then the temperature control is conducted at said intermediate control temperature for a predetermined period (for example 20 seconds) after the end of the continuous copying operation (steps S7-3 and S7-4), and then at the normal stand-by temperature which is 205° C. (step S7-5).

Such control allows to elevate the temperature with a suitable temperature step relative to the temperature at the end of the copying operation, and to suppress the overshoot phenomenon.

In the following there will be explained a fifth embodiment of the present invention, with reference to FIG. 17. In this embodiment, similar components as those in the first embodiment will be represented by the same symbols, and will not be explained further. The configuration of the fixing device of the present embodiment is similar to that in the first embodiment, except that the fixing roller is provided therein with only one heater.

Figure 17:
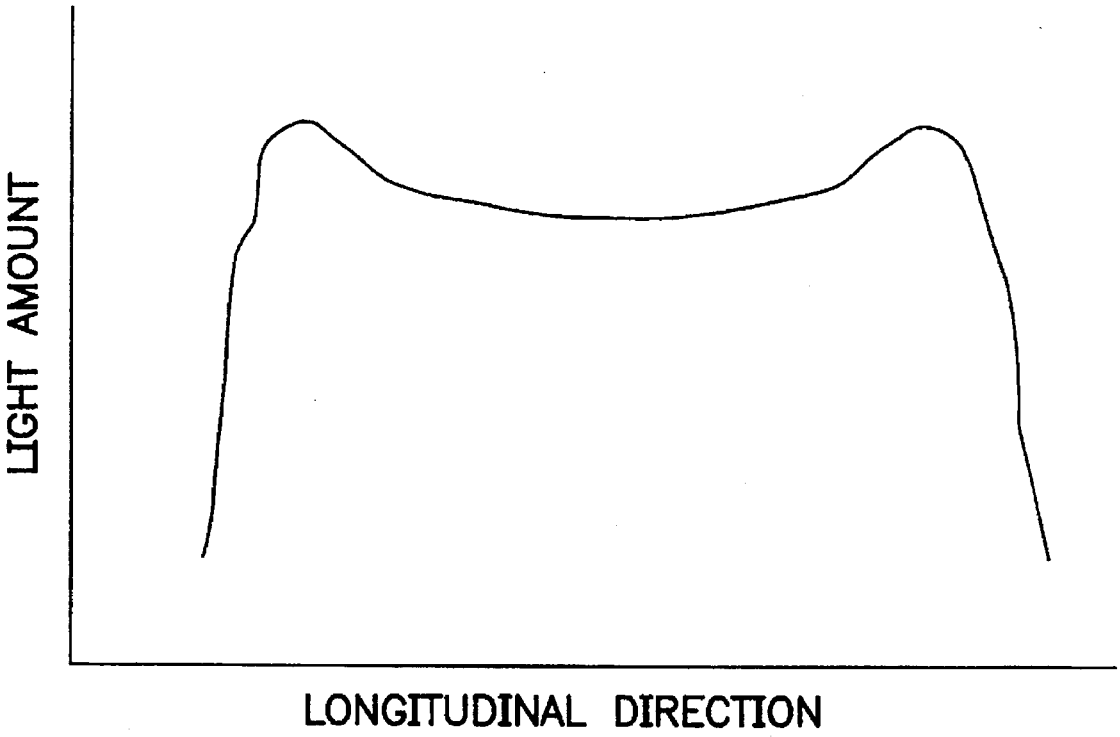
FIG. 17 is a chart showing the light amount distribution of the fixing heater in a fifth embodiment of the present invention.

FIG. 17 shows the light amount distribution of the fixing heater. In a system with such a single heater, the light amount is often made higher in the end portions, in consideration of a fact that the heat tends to be dissipated from the end portions. The control temperatures in the stand-by state and in the copying state are the same as those in the first embodiment.

Also in such configuration, the stepwise temperature control from the end of the continuous copying operation to the stand-by temperature control as in the foregoing embodiment allows to suppress the overshoot phenomenon. Also there can be obtained an inexpensive device as because the cost is lower in comparison with the system employing two heaters.

The present invention is not limited to the foregoing embodiments but includes any and all modifications belonging to the same technical concept.

What is claimed is:

1. A fixing device comprising:

a first heater;

a second heater having a heat distribution different from that of said first heater;

a heat member to be heated by said first heater and said second heater;

a temperature detecting element for detecting a temperature of said heat member; and power supply control means for controlling a power supply to said first heater and said second heater in such a manner that the temperature of said heat member detected by said temperature, wherein after a fixing operation and until the temperature detected by said temperature detecting element rises from a fixing temperature to a stand-by temperature for temperature adjustment, the stand-by temperature being higher than the fixing temperature, said power supply control means effects power supply control different from that in a stand-by state.

2. A fixing device according to claim 1, wherein said first heater generates a larger amount of heat in a central portion in the longitudinal direction of said heat member, and said second heater generates a larger amount of heat in end portions of said heat member.

3. A fixing device according to claim 2, wherein said temperature detecting element is provided in central area of said heat member.

4. A fixing device according to claim 1, wherein, after a fixing operation and until the temperature detected by said temperature detecting element rises from the fixing temperature to the stand-by temperature, said power supply control means is adapted to select a higher power supply ratio to said first heater than in the stand-by state.

5. A fixing device according to claim 1, wherein, after a fixing operation and until the temperature detected by said temperature detecting element rises from the fixing temperature to the stand-by temperature, said power supply control means is adapted to set the target temperature at a value higher than the fixing temperature but lower than the stand-by temperature, and then to set the target temperature at the stand-by temperature.

* * * * *

UNITED STATES PATENT AND TRADEMARK OFFICE

CERTIFICATE OF CORRECTION

PATENT NO. : 5,671,462
DATED : September 23, 1997
INVENTOR(S) : Yuichiro TOYOHARA, et al.

It is certified that error appears in the above-identified patent and that said Letters Patent is hereby corrected as shown below:

Column 9, line 33, delete "as".

Column 10, line 11, after "said", insert --temperature detecting element is maintained at a target--.

Signed and Sealed this

Fourteenth Day of April, 1998

Bruce Lehman

*Attest:*

BRUCE LEHMAN

*Attesting Officer*

*Commissioner of Patents and Trademarks*